US005486382A

United States Patent [19]

Ference et al.

[11] Patent Number: 5,486,382

[45] Date of Patent: Jan. 23, 1996

[54] METHOD FOR PREPARING A CERMET-COATED ARTICLE

[75] Inventors: Joseph A. Ference, San Diego; Ronald E. Bullock, Cardiff; Donald A. Uhlir, San Diego; Michael L. Duhl, San Diego; Sam A. Ropelato, San Diego, all of Calif.

[73] Assignee: Hughes Missile Systems Company, Los Angeles, Calif.

[21] Appl. No.: 57,392

[22] Filed: May 6, 1993

[51] Int. Cl.[6] ..... B05D 3/02

[52] U.S. Cl. ..... 427/376.3; 427/427

[58] Field of Search ..... 427/427, 376.3

[56] References Cited

U.S. PATENT DOCUMENTS

| | | | |
|---|---|---|---|
| 3,784,407 | 3/1971 | Shiio et al. | 427/376.3 |
| 4,567,059 | 1/1986 | Yamaoka et al. | 427/376.3 |
| 4,818,626 | 4/1989 | Werdecker et al. | 427/376.3 |
| 4,822,645 | 4/1989 | Odo et al. | 427/376.3 |
| 5,211,991 | 5/1993 | Bullock | 427/448 |
| 5,320,879 | 6/1994 | Bullock | 427/576 |

*Primary Examiner*—Benjamin Utech

*Attorney, Agent, or Firm*—Charles D. Brown; Randall M. Heald; Wanda Denson-Low

[57] ABSTRACT

An article (22) is coated with a cermet coating (20) by first roughening and oxidizing the surface to be coated. A mixture is formed of a metallic powder having a mean particle size of less than about 5 micrometers, and a ceramic powder having at least some of the particle of a size less than the mean particle size of the metallic powder. The mixture of the metallic powder and the ceramic powder desirably has a coating coefficient of thermal expansion of about that of the article coefficient of thermal expansion after firing. The mixture of metallic and ceramic powders is slurried and applied to the prepared surface (24) of the article (22), preferably by spraying. The coated article is heated to an intermediate temperature to vaporize the carrier liquid, and thereafter to high temperature to sinter the coating.

16 Claims, 1 Drawing Sheet

METHOD FOR PREPARING A CERMET-COATED ARTICLE

BACKGROUND OF THE INVENTION

This invention relates to ceramic/metallic (cermet) coatings on articles, and, more particularly, to a magnetic cermet coating that is applied by spraying a slurried mixture of metallic and ceramic particles.

When a material is irradiated, it is sometimes desirable to absorb some or all of the incident energy so that there is little reflected or re-radiated energy. This situation arises in commercial applications such as microwave cookery, industrial applications such as certain types of heat treatment, and military applications such as low-observables technology. In each of these situations, energy directed at a material is desirably absorbed at the surface of the material, and the resulting heat is dissipated within the material. There is little reflected or re-radiated energy.

One approach for enhancing energy absorption is the use of cermet materials. A cermet is a material which Incorporates both a metal and a ceramic into a single composite material. Cermets are usually prepared by mixing powders of a metal and a ceramic and densifying the mixture, as by sintering. The finished cermet exhibits some properties of the metal, some of the ceramic, and some that are a hybrid of each. The properties of the cermet may be controlled by selecting the materials used to form the cermet and varying their relative amounts, and the processing of the cermet.

It is known to use cermet coatings on an article to absorb incident energy directed toward the article. Such cermets incorporate magnetic metallic particles and ceramic particles. While the use of magnetic cermet coatings has been known, in some cases it is difficult to apply the coatings to achieve acceptable results. Existing approaches result in a cermet coating that Initially adheres to the article substrate, but that later may tend to debond from the article during elevated temperature exposure and/or cycling. Another problem is that the metallic particles oxidize during extended elevated temperature exposure, resulting in degradation of the magnetic properties. The maximum operating temperature of the cermet is limited by the Curie temperature of the magnetic metallic particles, above which temperature the particles become non-magnetic and less effective in absorbing incident energy.

There is a need for an improved approach to formulating and applying cermet coatings onto articles to be used at high temperature and repeatedly cycled between low and high temperatures, particularly where the metallic component of the cermet includes a magnetic metal. The present invention fulfills this need, and further provides related advantages.

SUMMARY OF THE INVENTION

The present invention provides an article protected by a cermet coating and a method for applying the cermet coating. Care is taken to use the proper constituents and processing to obtain good adherence of the coating to the article substrate, both initially, and during and after elevated temperature exposure and cycling. The metallic constituent is protected against oxidation. The protection against oxidation permits magnetic metallic particles to retain their magnetic properties even after extended elevated temperature exposure and cycling. Cermet coatings incorporating magnetic particles and prepared by the present approach absorb microwave energy even above the bulk Curie temperature of the magnetic metallic material.

In accordance with the invention, a method for preparing a cermet-coated article includes the step of providing an oxidized surface of an article to be coated. Preparation of the oxidized surface can include heating the uncoated article to an elevated temperature to form an oxide coating on the surface. A cermet coating mixture is prepared, including a metallic powder having a mean particle size of less than about 5 micrometers, and a ceramic powder having at least some of the particles of a size less than the mean particle size of the metallic powder. Optionally, the slurry may also contain a binder. If the coated article is to be used at elevated temperatures, the mixture of the metallic powder and the ceramic powder is preferably selected to have a coating coefficient of thermal expansion of about that of the article coefficient of thermal expansion after firing.

A slurry of the mixture of the metallic powder and the ceramic powder with a liquid carrier is formed, and the slurry is applied onto the prepared surface of the article, preferably by spraying. The coated article is thermally processed by heating the coated article to an intermediate temperature to vaporize and remove the liquid carrier and remove any binder that may have been used, and thereafter heating the coated article to a high temperature to sinter the cermet coating. The final steps of applying the slurry and thermal processing can be repeated several times to incrementally build up a coating that is several times thicker than that preferably produced by a single coating and sintering procedure.

The fine metallic powder particles produce good coating characteristics and, in the case of the use of magnetic particles, excellent magnetic and microwave absorptive properties. The ceramic powder has a fraction of its particles, preferably at least about 30–60 percent by volume, of a size smaller than the mean size of the metallic powder particles. The small ceramic particles lie in the interstices between the metallic particles and, as a result of thermal processing, form a matrix surrounding the metallic filler particles that minimizes the rate of oxidation and subsequent degradation.

The combination of surface preparation, cermet coating composition, coating application, and thermal processing causes the cermet layer to adhere well to the surface of the substrate. The cermet coating is retained on the surface and is operable even after extended exposure and thermal cycling to elevated temperatures. A maximum single-layer coating thickness of about 0.015 inches is preferred. Thicker coating layers can be formed by repeating the application and thermal processing steps with the same or a different cermet or other material.

Normally, a magnetic material loses its ability to absorb microwave energy above the bulk-material Curie temperature. The cermet of the invention retains microwave energy absorptive properties to even higher temperatures, an unexpected result. This permits the coating to operate as a microwave absorptive coating at temperatures above that which could be normally achieved with the combination of constituents.

The present invention thus provides an advance in the art. Adherent, long-lasting cermet coatings can be applied to substrates, as by an economical spraying process. Magnetic cermet coatings prepared by this approach can absorb microwave energy at temperatures above the bulk-material Curie temperature. Other features and advantages of the present Invention will be apparent from the following more detailed description of the preferred embodiment, taken in conjunction with the accompanying drawings, which Illustrate, by way of example, the principles of the invention.

DETAILED DESCRIPTION OF THE INVENTION

Figure 1:
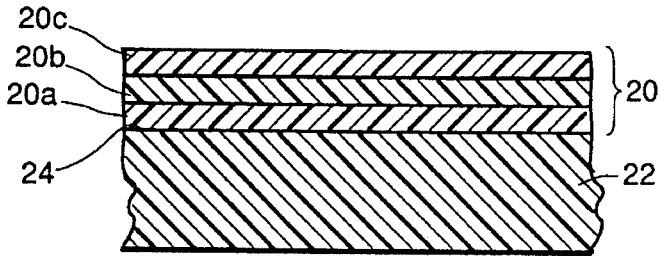
FIG. 1 is a schematic side sectional view of a coated article prepared by the present approach.

According to the present invention and as shown in FIG. 1, a cermet coating 20 is applied to an article 22, which serves as the substrate of the coating. The cermet coating 20 is preferably, but not necessarily, a magnetic cermet formed as a mixture of magnetic metallic particles and ceramic particles. The article 22 is preferably, but not necessarily, a nickel-base or cobalt-base alloy such as, for example, the known commercial alloys Hastelloy X, Inconel 625, Inconel 718, or Waspalloy. Other alloy types such as, for example, titanium alloys of the Ti-6Al-4V type and iron-based alloys such as steels and stainless steels, may also serve as substrates. The preferred embodiment of the invention will be discussed in relation to some of these exemplary alloys and a magnetic cermet coating, but the invention is not so limited.

Figure 2:
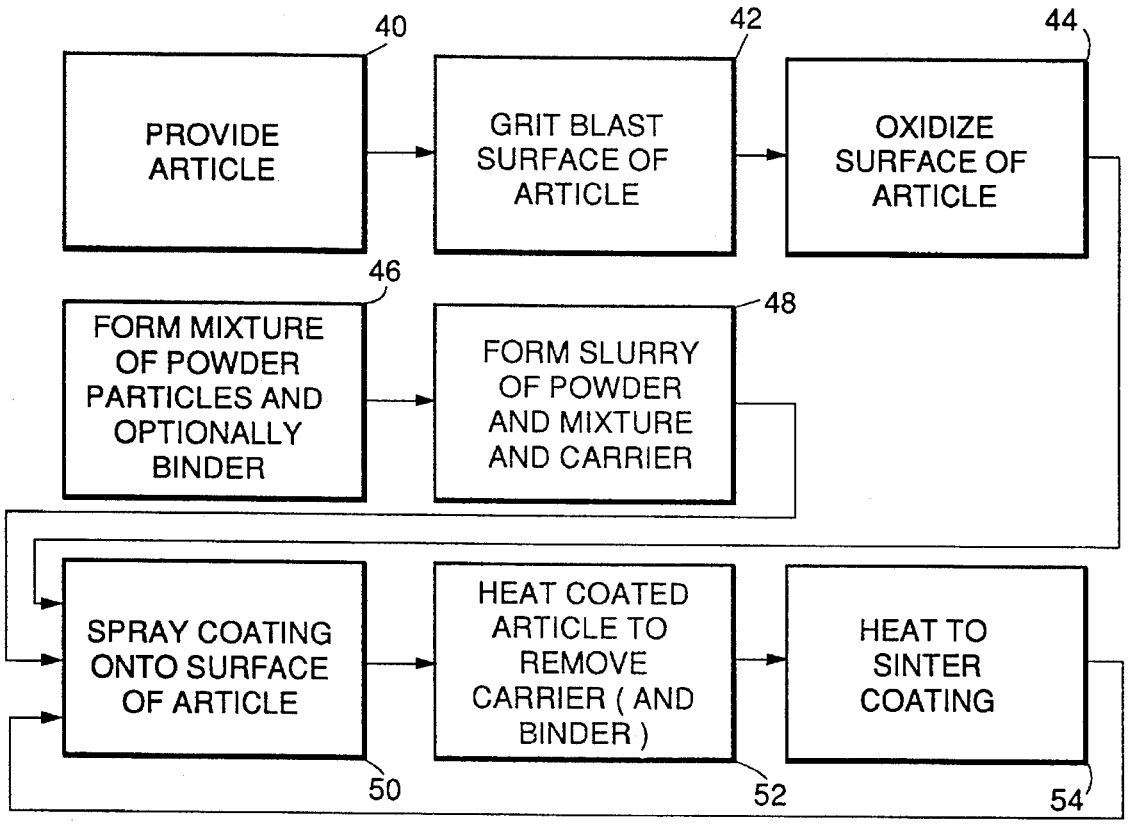
FIG. 2 is a process flow diagram for a preferred embodiment of the method of the invention.

FIG. 2 depicts the procedure by which the coating operation is accomplished. The article 22 to be coated is provided, numeral 40. Prior to application of the cermet coating, a surface to be coated is prepared by a two-step procedure. The first step is toughening a surface 24 to be coated by grit blasting, numeral 42, in the event that it is too smooth for good adhesion of the coating. The surface to be coated is grit blasted with a coarse abrasive such as aluminum oxide. The grit blasting roughens the surface to improve the adhesion of the coating 20 subsequently applied to the surface.

The second step of the surface preparation is to oxidize the surface by heating it to elevated temperature In an oxidizing atmosphere such as air, numeral 44. In a preferred approach, the article is heated in air to a temperature of about 1100 F. for at least about 30 minutes.

In a separate operation, the material that is to be applied as the coating is prepared by a two-step process. In the first step, a mixture of powder particles is formed, numeral 46. The powder mixture is formed of appropriate amounts of a metallic powder and a ceramic powder. For the preferred application of preparing a magnetic cermet, the metallic powder is a magnetic material such as pre-alloyed particles having a composition of about 90 weight percent iron and 10 weight percent aluminum. While this composition is preferred, other ferromagnetic compositions such as, for example, iron, other Iron-aluminum, iron-silicon, and cobalt alloys may be used. The particles are preferably roughly equiaxed, but the approach is not limited to any particular particle shape.

The processing characteristics and the cermet coating properties improve with decreasing particle size of the metallic powder. Specifically, when the metallic powder particles have a mean size of about 5 micrometers or less, the microwave absorption properties are improved and retained to temperatures above the bulk-metal Curie temperature. In specifying a mean particle size, it is recognized that metallic and ceramic powders prepared for industrial applications generally have a distribution of particle sizes. Here the mean of the distribution, which is determined by standard classification procedures, is used to specify the required particle size of the metallic component.

The ceramic powder is preferably a glass ceramic. A preferred composition is a glass having a composition of about 45 weight percent silica, 46 weight percent baria (barium oxide), and 9 percent boria (boron oxide), available commercially as SP-943 type glass. Although this ceramic is preferred, other ceramics such as, for example, silica, baria, boria, calcia, strontia, alumina, and mixtures thereof may be used. The practice of the invention is not limited to any particular type of metallic or ceramic powders.

The ceramic powder is sized such that at least some of the powder particles are smaller than the mean size of the metallic particles, which is about 5 micrometers or less. Preferably, at least about 30 to about 60 percent by volume of the ceramic particles have a size smaller than the mean metal powder size. If too few of the small ceramic particles are present, the final coating may have insufficient stability and resistance of the metallic powders to oxidation degradation. Most preferably, the mean particle size of the ceramic powder is smaller than the mean particle size of the metal powder. In the present case, the preferred glass ceramic powder of the composition indicated above was purchased from Specialty Glass, Inc. as type SP-943 glass powder with a mean particle size of about 2 micrometers.

The presence of at least some small particles of the ceramic powder is necessary to ensure that sufficient oxidation resistance of the metallic powders is achieved in the final coating. The small particles of the ceramic powders lie in the interstices between the metallic powder particles in the mix, and eventually In the coating. The small particles serve to envelop the metallic powder particles to retard the diffusion of oxygen to the metallic powder particles during extended exposure to elevated temperature. In the absence of the small ceramic particle fraction, oxidation and degradation of microwave absorption properties of the cermet coating 20 is observed after extended exposure at elevated temperature.

The metallic and ceramic powders and their relative amounts are selected such that the thermal expansion of the sintered cermet coating 20 is about the same as the thermal expansion of the article substrate 22. If the thermal expansion coefficients of the coating 20 and the article 22 are too greatly different, unacceptably high thermal stresses and strains are produced within the coating and at the coating/article boundary during fabrication and service at elevated temperatures. These thermal stresses and strains can lead to debonding and flaking away of the coating, a process generally termed spalling.

It is difficult to quantify the degree to which the thermal expansion coefficients must be matched, since the required matching depends to some extent upon the character of the substrate and the cermet, and the type of service use. In the situation of most interest to the inventors, the substrate has a coefficient of thermal expansion of about 6–10 microinches per inch per degree F. The coefficient of thermal expansion of the cermet coating is within about 3 microinches per inch per degree F of the coefficient of thermal expansion of the substrate, to achieve optimal performance in applications involving elevated temperature exposure. Larger differences between the coefficients of thermal expansion may lead to excessive thermal stresses and strains in the coating during service, and eventually to failure through a spallation mechanism. There may be other specific cases where larger differences could be acceptable, however.

In order to have approximate matching of the thermal expansions for particular selected types of metallic and ceramic powders, the relative amounts of the two types of powders may be varied. In the case of a Hastelloy X article, and the preferred mixture of magnetic particles and glass ceramic discussed above, it is preferred that the mixture formed in step 46 should have about 70 volume (86 weight) percent of the iron-aluminum metallic powder and about 30 volume (14 weight) percent of the SP-943 glass powder. The exact mixture of metallic and ceramic powders is also determined by performance requirements of the cermet coating, and can be varied accordingly.

The mixture formed in step 46 may optionally have a binder added In the amount of a few percent of the total weight of the mixture. The binder aids the mixture In adhering to the surface of the substrate article after application but prior to heat treatment. A binder such as polymethylmethacrylate (PMMA) is preferred.

After a dry mixture of the metallic and ceramic powders is prepared, a slurry of the dry mixture and a carrier liquid is formed, numeral 48. The carrier liquid may be any acceptable liquid which can be later removed without leaving an unacceptable residue and is otherwise acceptable in industrial operations. Methanol is the preferred carrier liquid in the present process, but other carrier liquids such as water, isopropyl alcohol, and acetone are also acceptable. The relative amounts of powder mixture and carrier are selected so that the slurry has acceptable flow properties for the selected application process. In the present case, for spray application a mixture of about 70 weight percent of the blended metallic and ceramic powders and about 30 weight percent of methanol is preferred.

The slurry is applied to the surface 24 of the article 22 as a wet coating layer, numeral 50. In the preferred embodiment, the slurry is sprayed using a conventional Binks-type spray gun with 25 pounds per square inch (psi) air pressure and a nozzle-to-surface distance of about 3–6 inches. The pass speed is about 30 inches per second. Care is taken to avoid runs or drips on the coating, because these areas may ultimately become sites of failure initiation.

The thickness of the coating layer is preferably selected to yield a final coating thickness of about 0.015 inches or less. The as-applied coating becomes thinner as the carrier and binder (if any) are removed during the initial stages of the heat treatment, and as voids are removed during the later, high-temperature, stages of the heat treatment. The amount of the reduction depends upon the coating type and slurry composition. In a typical case, the reduction in thickness of the as applied coating after heat treatment is about 10–20 percent. For example, an initially applied "wet" coating of 0.015 inches thickness may be reduced to a final thickness of about 0.012–0.019 inches at the conclusion of the heat treatment.

After the "wet" coating layer is applied, the article and wet coating layer are heated to an intermediate temperature in order to vaporize and remove the liquid carrier and any binder (if present), numeral 52. For a methanol carrier, heating to a temperature of about 200 F. for 30 minutes is usually sufficient to remove the carrier liquid.

The article with its cermet coating is thereafter heated to a high temperature sufficient to sinter the cermet of the coating, numeral 54. The required temperature will depend upon the metallic and ceramic constituents of the coating and their particle sizes, as well as the required degree of densification of the coating. For the preferred cermet mixture of 90 weight percent iron-10 weight percent aluminum metallic particles and SP-943 glassy ceramic particles, sintering at a temperature of about 1500 F.–1600 F. for times of 1–1.5 hours is sufficient to produce a high density of the coating and good adherence of the coating 20 to the article 22.

The preferred maximum thickness of the coating 20 is about 0.015 inches after sintering. If a thicker coating is required, the spray step 50, heating step 52, and heating step 54 may be repeated in that order as many times as necessary to build up a thick coating. In the coated article depicted in FIG. 1, there are three sub-layers 20*a*, 20*b*, and 20*c* that are sequentially deposited in this manner. In practicing this embodiment of the invention, the first sub-layer 20*a* was sintered at 1600 F. for 1 hour, the second sub-layer 20*b* was sintered at 1550 F. for 75 minutes, and the third sub-layer 20*c* was sintered at 1500 F. for 90 minutes.

Articles prepared according to the preceding preferred approach were tested in several ways to verify that an acceptable coating had been attained. In each case, the coating is the 90 weight percent iron-10 weight percent aluminum alloy and SP-943 glass prepared as described previously, and the previously described coating procedure was used. The following examples are intended to illustrate aspects of the invention, and should not be interpreted as limiting the invention in any respect.

EXAMPLE 1

The rear bearing housing, made of Inconel 625 alloy, of an F-107-WR-400 model gas turbine engine was coated with the magnetic cermet. The coated article was heated to 900 F. for 10 hours. The coating showed excellent performance.

EXAMPLE 2

A divergent seal and flap assembly, made of Waspalloy and Inconel 718 alloys, of an F-100 model gas turbine engine was coated with the magnetic cermet. The divergent seal and flap was subjected to 1500 simulated tactical aircraft engine cycles to a maximum temperature of 1210 F. The seal performed well and the flap showed some mechanical wear.

EXAMPLE 3

The microwave radar cross section of the divergent seal and flap of Example 2 was determined after the completion of the 1500 cycles of testing. The seal and flap exhibited substantial radar cross section reduction over a range of radar frequencies.

EXAMPLE 4

An F-112-WR-100 model gas turbine engine exhaust duct and collar assembly, made of Inconel 625 alloy and 15–5 PH stainless steel alloy, respectively, was coated with the magnetic cermet. The assembly was heated to 900 F. for 10 hours. The coating showed excellent performance.

EXAMPLE 5

Flat-plate coated samples were prepared of article substrates made of Ti-6Al-4V, Hastelloy X, and Haynes 188 alloys. The plates were cycled 600 times in a JP-4 flame burner rig. Each cycle included 5 minutes at a maximum temperature followed by 3 minutes of forced-air cooling. The maximum temperatures were 1000 F. for the T1-6Al-4V plates and 1500 F. for the Hastelloy X and Haynes 188 plates. All of the samples exhibited excellent performance.

EXAMPLE 6

Coated flat plate samples of Inconel 625 alloy were prepared. The samples were subjected to a thermal excursion of cooling to −65 F., and, after equilibration at that temperature, heating to 900 F. in 15 seconds to test for debonding of the coating. There was no observed damage to the coating.

EXAMPLE 7

Blocks of Inconel 625 alloy were coated. The bond strength of the coating was tested at room temperature. The coating failed by cohesive failure within the coating at a stress of about 875 pounds per square inch, and did not fall adhesively at the bond line. Strong bonding of the coating to the substrate is indicated by this result.

EXAMPLE 8

Flat plates of Hastelloy X alloy were coated. The coated surfaces were intensely heated by a plasma torch to a temperature of about 2000 F. for 5 seconds. No debonding was observed.

EXAMPLE 9

A 6-inch by 6-inch panel of Inconel 625 alloy was coated. The microwave absorption of the panel was measured in a test cell as a function of temperature from ambient temperature to 1400 F. The coated panel achieved 93 percent retention of absorption and a null variation of only 0.64 gigahertz at 1400 F. as compared with ambient temperature. The bulk Curie temperature of the 90 percent iron, 10 percent aluminum alloy is at about 1265 F. The microwave absorption of the coated panel was retained at temperatures well above the Curie temperature.

Although particular embodiment of the invention have been described in detail for purposes of illustration, various modifications may be made without departing from the spirit and scope of the invention. Accordingly, the invention is not to be limited except as by the appended claims.

What is claimed is:

1. A method for preparing a cermet-coated article, comprising the steps of:

providing an oxidized surface on an article to be coated, including the step of providing an article made of a material selected from the group consisting of a nickel-base alloy, a cobalt-base alloy, an iron-base alloy, and a titanium-base alloy;

preparing a mixture of a metallic powder having a mean particle size of less than about 5 micrometers, and a ceramic powder having at least some of the particles of a size less than that of the mean particle size of the metallic powder, forming a slurry of the mixture of the metallic powder and the ceramic powder with a liquid carrier;

applying a coating of the slurry onto the oxidized surface of the article; and thermally processing the coated article, the step of thermally processing the coated article, the step of thermally processing including the steps of heating the coated article to a temperature sufficient to vaporize and remove the liquid carrier, and thereafter heating the coated article to a temperature sufficient to sinter the cermet coating.

2. The method of claim 1, wherein the step of preparing a mixture includes the step of providing a metallic powder that is a magnetic material.

3. The method of claim 1, wherein the step of preparing a mixture includes the step of providing a prealloyed metallic powder having about 90 weight percent iron and about 10 weight percent aluminum.

4. The method of claim 1, wherein the step of preparing a mixture includes the step of providing a glassy ceramic powder.

5. The method of claim 1, wherein the step of preparing a mixture includes the step of mixing about 70 percent by volume of the metallic powder and about 30 percent by volume of the ceramic powder.

6. The method of claim 1, wherein the step of forming a slurry includes the step of providing a liquid carrier selected from the group consisting of methanol, isopropyl alcohol, acetone, and water.

7. The method of claim 1, wherein the step of forming a slurry includes the step of mixing about 70 volume percent of the mixture of the metallic powder and the ceramic powder, with about 30 volume percent of the carrier liquid.

8. The method of claim 1, wherein the step of applying includes the step of spraying a coating of the slurry onto the oxidized surface of the article.

9. The method of claim 1, wherein the step of heating the coated article to a temperature sufficient to vaporize and remove the liquid carrier includes the step of heating to a temperature of about 200 F.

10. The method of claim 1, wherein the step of heating to a temperature includes the step of heating to a temperature of about 1500 F. to about 1600 F.

11. The method of claim 1, including the additional step of performing the steps of applying a coating and thermally processing at least one additional time.

12. The method of claim 1, wherein the step of preparing a mixture includes the step of selecting the metallic powder, the ceramic powder, and the relative amounts of the metallic powder and the ceramic powder such that the thermal expansion coefficient of a sintered coating, resulting from the step of thermally processing, is within about 9 microinches per inch per degree F of a coefficient of thermal expansion of the article.

13. A method for preparing a cermet-coated article, comprising the steps of:

providing an article to be coated, the article having an article coefficient of thermal expansion;

preparing a surface of the article to be coated, the step of preparing the surface including the step of heating the uncoated article to an elevated temperature to form an oxide coating on the surface, resulting in a prepared surface;

preparing a mixture of a metallic magnetic powder having a mean particle size of less than about 5 micrometers, and a ceramic powder having at least some of the particles of a size less than that of the mean particle size of the metallic powder, the mixture of the metallic powder and the ceramic powder having a coating coefficient of thermal expansion of about that of the article coefficient of thermal expansion after firing;

forming a slurry of the mixture of the metallic powder and the ceramic powder with a liquid carrier;

applying a coating of the slurry onto the prepared surface of the article; and thermally processing the coated article, the step of thermally processing including the steps of heating the coated article to a temperature sufficient to vaporize and remove the liquid carrier, and thereafter heating the coated article to a temperature sufficient to sinter the cermet coating.

14. The method of claim 13, wherein the step of heating the uncoated article Includes the step of heating the uncoated article to a temperature of about 1100 F. in air.

15. The method of claim 13, wherein the step of preparing a mixture includes the step of selecting the metallic powder, the ceramic powder, and the relative amounts of the metallic powder and the ceramic powder such that the thermal expansion coefficient of a sintered coating, resulting from the step of thermally processing, is within about 3 microinches per inch per degree F of a coefficient of thermal expansion of the article.

16. A method for preparing a cermet-coated metallic article, comprising the steps of:

providing a metallic article to be coated, the article having an article coefficient of thermal expansion;

preparing a surface of the article to be coated, the step of preparing the surface including the steps of roughening the surface that is to be coated, and heating the uncoated article to an elevated temperature to form an oxide coating on the roughen ed surface, resulting in a prepared surface;

preparing a mixture of a metallic magnetic powder having a mean particle size of less than about 5 micrometers, and a ceramic powder having a mean particle size less than that of the mean particle size of the metallic powder, forming a slurry of the mixture of the metallic powder and the ceramic powder with a liquid carrier;

spraying a coating of the slurry onto the prepared surface of the article; and thermally processing the coated article, the step of thermally processing including the steps of heating the coated article to a temperature sufficient to vaporize and remove the liquid carrier, and thereafter heating the coated article to a temperature sufficient to sinter the cermet coating, the mixture of the metallic powder and the ceramic powder having been selected such that a coating coefficient of thermal expansion of the sintered coating is within about 3 microinches per inch per degree F of the article coefficient of thermal expansion.

* * * * *